US009928848B2

(12) United States Patent
Cahill et al.

(10) Patent No.: US 9,928,848 B2
(45) Date of Patent: Mar. 27, 2018

(54) AUDIO SIGNAL NOISE REDUCTION IN NOISY ENVIRONMENTS

(71) Applicant: Intel Corporation, Santa Clara, CA (US)

(72) Inventors: Niall Cahill, Galway (IE); Jakub Wenus, Maynooth (IE); Mark Y. Kelly, Leixlip (IE); Michael Nolan, Maynooth (IE)

(73) Assignee: INTEL CORPORATION, Santa Clara, CA (US)

( * ) Notice: Subject to any disclaimer, the term of this patent is extended or adjusted under 35 U.S.C. 154(b) by 47 days.

(21) Appl. No.: 14/998,203

(22) Filed: Dec. 24, 2015

(65) Prior Publication Data

US 2017/0186442 A1 Jun. 29, 2017

(51) Int. Cl.

| | |
|---|---|
| ***G10L 21/028*** | (2013.01) |
| ***G10L 21/0216*** | (2013.01) |
| ***G10L 21/0308*** | (2013.01) |
| *G10L 21/0208* | (2013.01) |

(52) U.S. Cl.

CPC ..... *G10L 21/028* (2013.01); *G10L 21/0216* (2013.01); *G10L 21/0308* (2013.01); *G10L 2021/02087* (2013.01)

(58) Field of Classification Search

CPC ..... G10L 2021/02087

See application file for complete search history.

(56) References Cited

U.S. PATENT DOCUMENTS

2009/0089054 A1* 4/2009 Wang ..... H04M 9/082 704/233
2009/0147961 A1* 6/2009 Lee ..... H04S 3/008 381/2
2009/0222262 A1* 9/2009 Kim ..... G10L 21/0272 704/231
2010/0296665 A1* 11/2010 Ishikawa ..... G10L 21/0208 381/71.1
2014/0369515 A1* 12/2014 Trammell ..... H04R 3/005 381/71.1
2015/0003621 A1 1/2015 Trammell
2015/0016623 A1* 1/2015 Trammell ..... G10K 11/178 381/71.4

(Continued)

FOREIGN PATENT DOCUMENTS

WO WO 2005/083706 * 9/2005

OTHER PUBLICATIONS

International Search Report and Written Opinion issued in PCT Application No. PCT/US2016/063785, dated Mar. 13, 2017, 14 pages.

(Continued)

*Primary Examiner* — Qian Yang
(74) *Attorney, Agent, or Firm* — Grossman Tucker Perreault & Pfleger, PLLC

(57) ABSTRACT

An audio signal processing system removes at least a portion of a noise component from a number of audio input signals generated by a number of closely proximate agents within an input signal source location. The availability of each audio input signal and the geographically proximate location of each of the agents creating an audio input signal facilitates the real-time or near real-time reduction in ambient noise level in each of the audio input signals using a Blind Sound Source Separation (BSSS) technique.

18 Claims, 7 Drawing Sheets

(56) References Cited

U.S. PATENT DOCUMENTS

2017/0085985 A1* 3/2017 Kim ..... H04R 3/005

OTHER PUBLICATIONS

"12 Quick Ways to Deal with Call Centre Noise", http://www.callcentrehelper.com/12-quick-ways-to-deal-with-call-centre-noise-10971.htm, downloaded Jun. 12, 2017, 6 pages.
Barrett, Sue: "The problem with noisy call centres", Smart Company, http://www.smartcompany.com.au/marketing/sales/35836-the-problem-with-noisy-call-centres.html, Mar. 2, 2014, 6 pages.
Hyvärinen, A. et al.: "Independent Component Analysis", John Wiley & Sons, Inc., Mar. 7, 2001, 502 pages.
http://research.ics.aalto.fi/ica/fastica/, downloaded Jun. 13, 2017, 2 pages.
http://www.ism.ac.jp/~shiro/research/blindsep.html, downloaded Jun. 13, 2017, 2 pages.
Aksin, Zeynep, et al.: "The Modern Call Center: A Multi-Disciplinary Perspective on Operations Management Research", Productions and Operations Management, vol. 16, No. 6, Nov.-Dec. 2007, pp. 665-688.

* cited by examiner

AUDIO SIGNAL NOISE REDUCTION IN NOISY ENVIRONMENTS

TECHNICAL FIELD

The present disclosure relates to audio signal processing, more particularly to audio signal processing in noisy environments.

BACKGROUND

For many companies, particularly companies engaged in some form of e-commerce, maintaining a high-quality call center is a crucial component to achieving consistently high customer satisfaction. Nonetheless, call center customers persistently complain about background acoustic noise present on telephone calls received by call center agents. This background acoustic noise degrades the quality of the conversation between the customer and the call center agent which, in turn, leads to reduced customer satisfaction and associated effects. The greatest contributor to background acoustic or ambient noise in such call-center settings is mostly comprised of other agents' voices on the call center floor as they converse with other customers. The prevalence of the acoustic or ambient noise may be at least partially attributable to the layout of many call centers where floor space is minimized by packing agents into as physically small a footprint as possible. As optimizing customer service represents a central focus of call centers, a strong need exists for solutions that minimize the noise provided by these background conversations.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
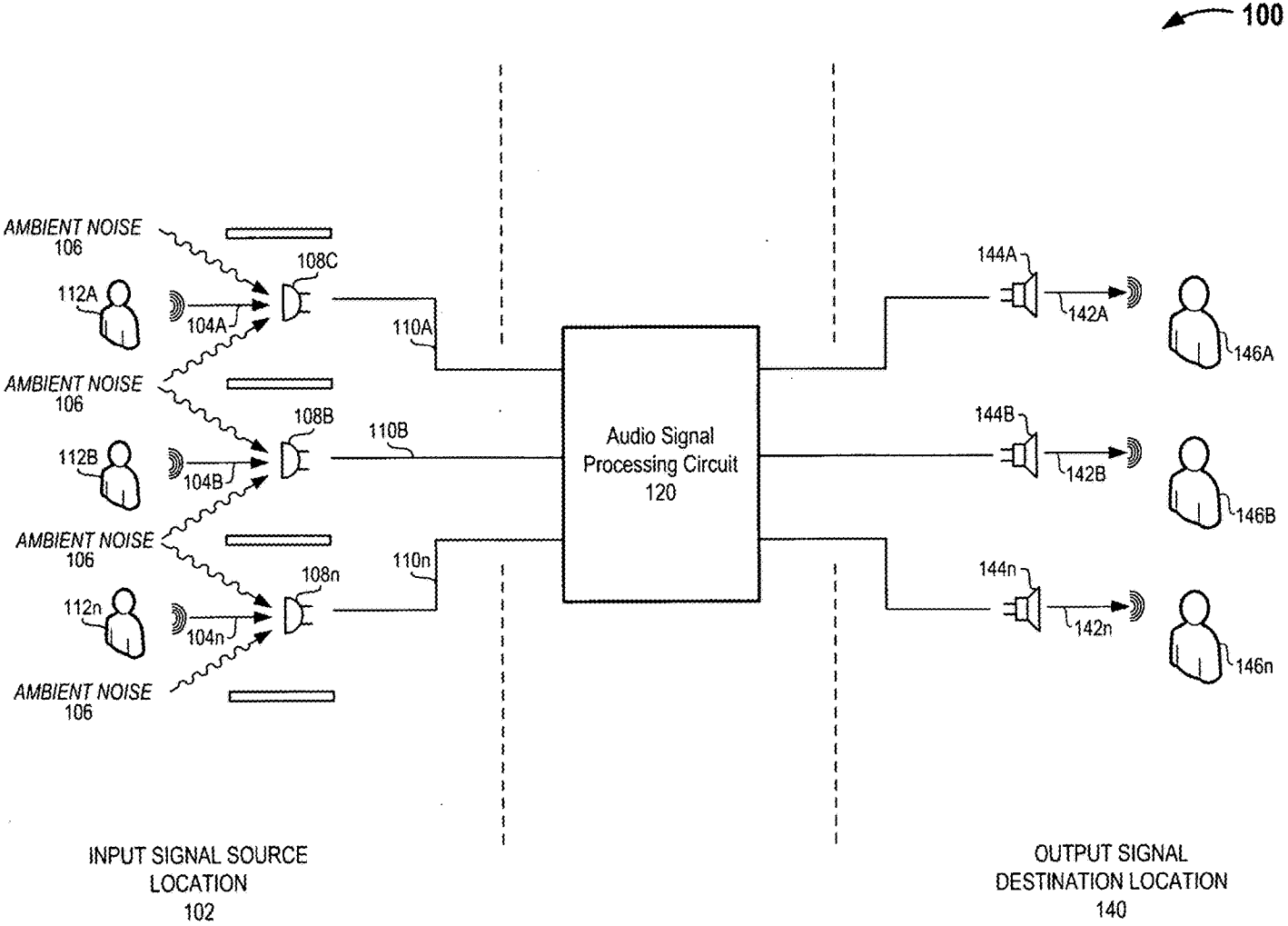
FIG. 1 is a schematic diagram of an example audio signal processing system, in accordance with at least one embodiment of the present disclosure.

Although the following Detailed Description will proceed with reference being made to illustrative embodiments, many alternatives, modifications and variations thereof will be apparent to those skilled in the art.

DETAILED DESCRIPTION

An audio signal processing system as described in embodiments herein may be used to enhance the quality of the customer experience, particularly when applied in the context of a call center having a relatively large number of customer service agents distributed in a relatively compact footprint. In embodiments, the audio signal processing system may continuously capture audio signals from each of a number of agents on the call center floor who are engaged in a customer conversation. For each agent on a separate call, the audio processing system combines the audio signals of nearby or proximate agents via an online Blind Sound Source Separation (BSSS) technique to remove the noise that each of the other signals contributes to the respective agent's call. Such a technique does not require additional information about the noise signals, and may result in a significant reduction in the background noise level being sent to the customer from the call center and consequently a significant improvement in the overall perceived quality of the telephone conversation. Such represents a significant improvement in the customer experience and an increase in customer satisfaction.

In embodiments, the audio call processing system enhances the quality of the audio of call center agents during telephone conversations held by call center agents in a conventional call center floor scenario. The audio call processing system reduces the acoustical background noise that may be present on an agent's call by removing the component of background acoustic noise attributable to nearby agents that are conversing on the call center floor. In embodiments, the reduction in background noise may be accomplished by leveraging the availability of audio signals corresponding to the conversations held by nearby agents to estimate and mitigate the effect of the conversations from the agent's audio signals. In embodiments, to estimate the effect of these signals, the noise signal component included in the agent's call may be treated as a Blind Sound Source Separation problem that may be resolved using one of any number of techniques, for example using a convolutive BSSS approach.

An audio signal processing controller is provided. The audio signal processing controller may include an input interface portion, an output interface portion, and at least one audio processing circuit communicably coupled to the input interface portion, the output interface portion, and at least one storage device. The at least one storage device may include machine-readable instructions that, when executed by the at least one audio processing circuit, cause the at least one audio processing circuit to, for each of a plurality of physically proximate audible audio sources: receive, at the input interface portion, a first audio signal that includes at least an audible audio component and a noise component; combine the audio signals from the remaining physically proximate audible audio sources; reduce the noise component in the first audio signal using the combined audio signals from the remaining physically proximate audio sources; and provide the first audio signal with the reduced noise component as an output audio signal at the output interface portion.

An audio signal processing method is also provided. The method may include receiving a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source. The method may further include combining, by at least one audio processing circuit communicably coupled to the input interface portion, a plurality of audio signals, each of the audio signals representative of the audible ambient noise generated by a respective one of the plurality of audio sources physically proximate the first audio source. The method may additionally include reducing, by the at least one audio processing circuit, the noise component in the first audio signal using the combined audio signals and transmitting, by the at least one audio processing circuit, a first audio output signal having a reduced noise component to a communicably coupled output interface portion.

A storage device that includes machine-readable instructions is provided. The machine-readable instructions, when executed by at least one audio processing circuit, may cause the at least one audio processing circuit to: receive a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source; combine a plurality of audio signals, each of the audio signals representative of the audible ambient noise generated by a respective one of the plurality of audio sources physically proximate the first audio source; reduce the noise component in the first audio signal using the combined audio signals; and transmit a first audio output signal having a reduced noise component to a communicably coupled output interface portion.

Another audio signal processing system is also provided. The audio signal processing system may include a means for receiving a first audio signal that includes an audible audio component generated by a first audio source and an ambient noise component that includes an audio signal representative of an audible ambient noise generated by a plurality of audio sources physically proximate the first audio source. The system may further include a means for combining a plurality of audio signals, each of the audio signals representative of the audible ambient noise generated by a respective one of the plurality of audio sources physically proximate the first audio source. The system may additionally include a means for reducing the noise component in the first audio signal using the combined audio signals and a means for transmitting a first audio output signal having a reduced noise component to a communicably coupled output interface portion.

As used herein, the terms "top" and "bottom" are intended to provide a relative and not an absolute reference to a location. Thus, inverting an object described as having a "top portion" and a "bottom portion" may place the "bottom portion" on the top of the object and the "top portion" on the bottom of the object. Such configurations should be considered as included within the scope of this disclosure.

As used herein, the terms "first," "second," and other similar ordinals are intended to distinguish a number of similar or identical objects and not to denote a particular or absolute order of the objects. Thus, a "first object" and a "second object" may appear in any order—including an order in which the second object appears before or prior in space or time to the first object. Such configurations should be considered as included within the scope of this disclosure.

FIG. 1 is a schematic diagram of an example audio signal processing system 100, in accordance with at least one embodiment of the present disclosure. As depicted in FIG. 1, an audio signal processing circuit 120 communicably couples a number of audible inputs 104A-104*n* (collectively, "audible inputs 104") disposed in an input signal source location 102 to a corresponding number of audible outputs 142A-142*n* (collectively, "audible output 142") disposed in an output signal destination location 140. Each of the audible inputs 104A-104*n* may be received by a respective audio input device 108A-108*n* (collectively, "audio input devices 108"). Each of the audio input devices 108A-108*n* produces a respective audio input signal 110A-110*n* (collectively "audio input signals 110") that may include an audible audio component that includes information and/or data representative of the respective audible input 104 and a noise component that includes information and/or data representative of an ambient noise 106 collected or otherwise received by the respective audio input device 108.

In various implementations, some or all of the audio input devices 108 may be disposed in a common input signal source location 102. Such input signal source locations 102 may include any forum, location, or locale in which a number of parties 112A-112*n* are communicably coupled to a number of recipients 146A-146*n*. Non-limiting examples of such input signal source locations 102 may include stadiums, theatres, gatherings, or other similar locations where a number of people may gather and objectionable levels of environmental ambient noise, including spillover audible inputs 104, may be present in the audio input signals 110.

An example input signal source location 102 may include locations such as call centers or customer service or support centers. For clarity and ease of discussion, a call center will be used as an illustrative example implementation of an audio signal processing system 100. Those of skill in the art will readily appreciate the broad applicability of the systems and methods described herein in audio signal processing applications that extend beyond the call center environment, such as the stadium, theater, and public gathering examples provided previously. In various specific implementations, each of a number of call center operators 112A-112*n* (collectively, "call center operators 112") in a single input signal source location 102 may be engaged in conversations with a respective call center customer 142A-142*n* (collectively "call center customers 142"). Each of the call center customers 142 may be in the same or different output signal destination locations 140.

In implementations, the audio signal processing circuit 120 receives the audio input signals 110, including both the audible audio component and the noise component, for each of the audio input signals 110. For each received audio input signal 110, the audio signal processing circuit 120 removes at least a portion of the noise component present in the respective audio input signal 110. The removal of at least a portion of the noise component present in the respective audio input signal 110 may provide an audible output 142 having a noise component that is substantially reduced when compared to the noise component of the respective audible input 104. In embodiments, the audio signal processing circuit 120 removes the portion of the noise component in each respective one of the audio input signals 110 using at least a portion of the audible audio component, at least a portion of the noise component, or some combination thereof for each of the remaining audio input signals 110. In embodiments, the availability of the audio input signals 110 generated by the proximate audio input devices 108 beneficially permits the real-time removal of at least a portion of the noise component present in the each respective audio input signal 110. Advantageously, such noise removal may be performed using single element audio input devices 108 rather than multi-directional or multi-element audio input devices 108.

Existing general speech enhancement products typically encompass speech enhancement techniques applied directly to the audible input 104 during capture or shortly thereafter. Existing general speech enhancement products fail to take advantage of the availability of audio input signals 110 generated by proximate or nearby audio input devices 108. Existing speech enhancement products may be generally grouped into single microphone technology that applies spectrally shaped (e.g., Wiener) filters to the audio input signal 110, or microphone array technology that filters audio signals based on angle of arrival.

In the context of call centers and similar large staff customer support facilities, single microphone technologies often provide an attractive and cost effective solution since they require only a relatively inexpensive single microphone headset. However, since speech is non-stationary and single microphone noise abatement or cancelation technologies typically assume a stationary or slowly-varying noise source, such technologies have limited value in the relatively mobile and noisy environment found in many large scale call center operations.

In contrast, noise abatement or cancellation technologies employing microphone array technologies can achieve good speech enhancement performance in a large scale call center environment. Microphone arrays are able to attain such performance by blocking those noise signals 106 that do not arrive in a direction similar or identical to the audible input 104 (e.g., from the same direction as the voice of the call center operator). However, such microphone array systems require an array on each headset in the call center—a prohibitively expensive option for many call centers.

In embodiments described herein, a headset that includes only a single audio input device 108, such as a single microphone, may be used in conjunction with one or more audio signal processing circuits 120 to enhance the audible input 104, such as a call center agent's 112 audible input 104 (i.e., the call center agent's 112 voice). Such single microphone solutions are cost competitive and flexibly implemented within a large call center environment. In embodiments described herein, the audio signal 110 from a single audio input device 108 is used to achieve a significant reduction in ambient noise levels in the audible output signal 142 provided to a call center customer 146.

The audio signal processing circuit 120 may be disposed in any of a variety of locations. In some implementations, the audio signal processing circuit 120 may execute on one or more private or public cloud-based servers. In such an implementation, the one or more cloud based servers may receive some or all of the audio input signals 110A-110*n* from the call center operators 112. In other implementations, the audio signal processing circuit 120 may be distributed among multiple processor-based devices, for example among a desktop processor-based device collocated with some or all of the call center operators 112. In such an implementation, the desktop processor-based devices may be networked or otherwise communicably coupled such that at least a portion of the audio input signals 110 are shared among at least a portion of the processor-based devices.

In various embodiments, the audio signal processing circuit 120 may use a Blind Sound Source Separation (BSSS) technique to separate the noise component from the audible audio component in each of the audio input signals 110. The Blind Sound Source Separation technique permits the separation of sound sources present in a mixed signal with minimal information regarding the sources of each of the sounds. In the context of an input signal source location 102 where at least some, if not all, of the sound sources are known, the Blind Sound Source Separation technique may be simplified to provide a rapid, accurate, sound separation which facilitates noise reduction and/or elimination in each of the audible outputs 142. For example, where a call center is the input signal source location 102, the ambient noise 106 may primarily consist of extraneous conversation by nearby call center operators 112. In such an instance, the audio input signals 110 from each of the nearby call center operators 112 is available to the audio signal processing circuit 120, and using the Blind Sound Source Separation technique the extraneous conversation (i.e., the "noise component") in each audio input signal 110 may be separated, in real-time or near real-time, from the audible audio component in the respective audio input signal 110.

In embodiments, the audio signal processing circuit 120 may be implemented on a plurality of processor-based devices, for example on a number of networked or otherwise communicably coupled processor-based devices at each agent 112 and/or on a centralized server that is networked or communicably coupled to processor-based devices at each agent 112. In such embodiments, the client processor-based device may capture all or a portion of the audible input 104 provided by an agent 112. In turn, each agent processor-based device may stream the audio input signal 110, containing both the audible audio component and the noise component, to the centralized server using a suitable real-time streaming protocol. The audio signal processing circuit 120 implemented on the centralized server receives the audio input signal 110 from each of the agent processor-based devices, aggregates the audio input signals 110, enhances each audio input signal 110 by separating the audible audio component and the noise component to provide, via an output device 144, a low noise, enhanced audible output 142 to each respective customer 144. In embodiments, a centralized server may process the audio input signals 110 received from each respective one of the agent's processor based devices in parallel using only audio input signals 110 from physically proximate agents 112. In other embodiments, the centralized server may process the audio input signals 110 received from each respective one of the agent's processor based devices are pooled and centrally processed.

Figure 2A:
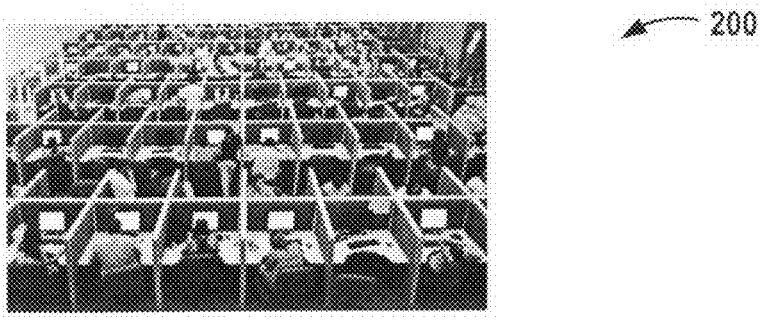
FIG. 2A is an image of an illustrative call center, in accordance with at least one embodiment of the present disclosure.
Figure 2B:
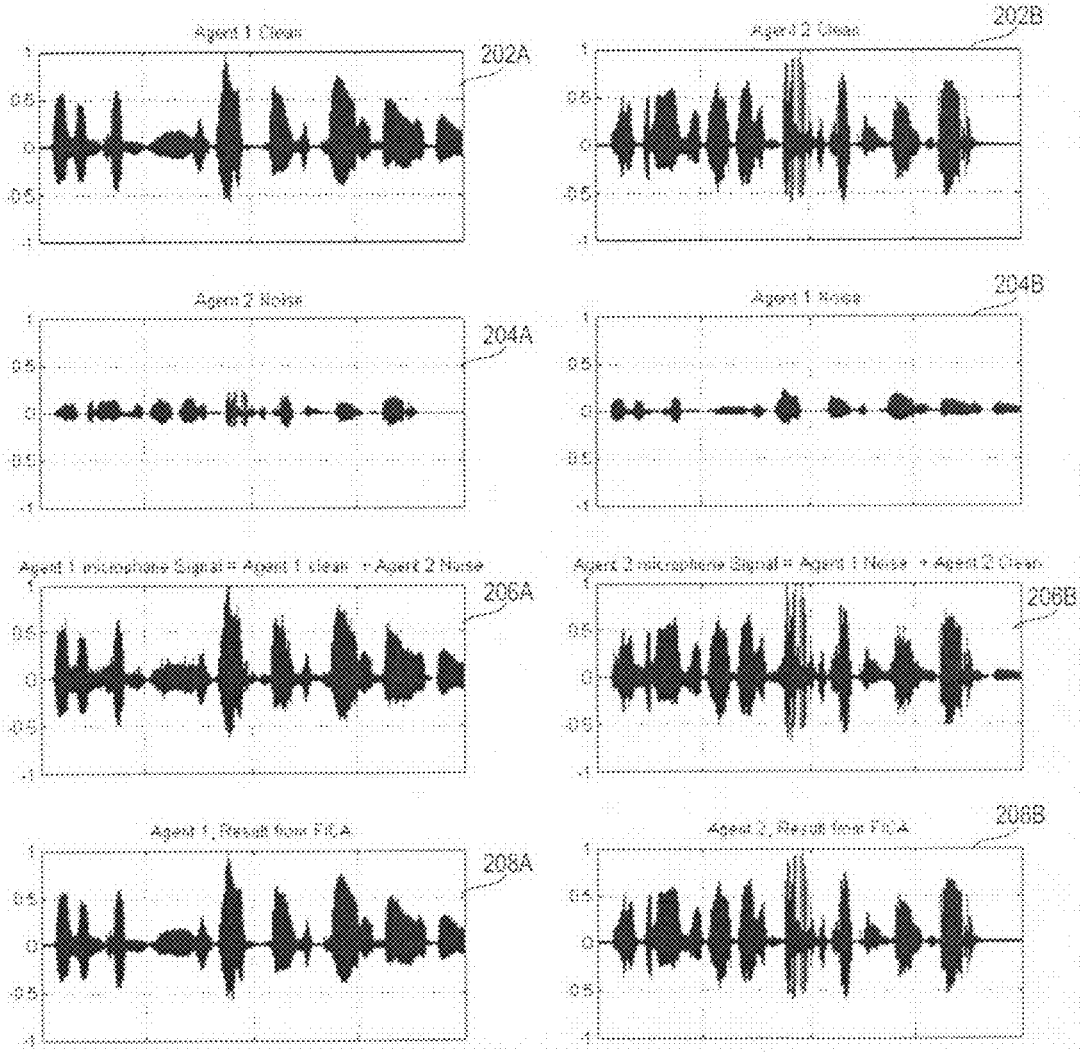
FIG. 2B is a series of plots demonstrating the performance of an example audio signal processing system such as that depicted in FIG. 2A, in accordance with at least one embodiment of the present disclosure.

FIG. 2A is photograph of an illustrative call center that serves as an example input signal source location 102, in accordance with at least one embodiment of the present disclosure. FIG. 2B provides a series of frequency versus time plots demonstrating the accuracy of a Blind Sound Source Separation (BSSS) technique applied to linearly mixed signals such as audio input signals 110 generated in a source location 102 such as the call center depicted in FIG. 2A, in accordance with at least one embodiment of the present disclosure. Input signal source locations 102, such as the call center depicted in FIG. 2A, provide a simplified mixing model that may be exploited for better separation of the sources for less computational load.

For simplicity of discussion and clarity, an input signal source location 102 having two agents 112, designated "agent 1" and "agent 2" is used in the following illustrative example. Within the input signal source location 102, agent 1 and agent 2 are located such that agent 2's audible input 104B is overheard by agent 1 and represents a noise signal 106 captured by agent 1's audible input device 108A. Agent 1's audio input signal 110A therefore consists of an audible audio component that includes agent 1's audible input 104A and a noise component that includes at least agent 2's audible input 104B. Similarly, agent 2's audio input signal 110B consists of an audible audio component that includes agent 2's audible input 104B and a noise component that includes agent 1's audible input 104A. Each agent's audio input device 108A, 108B is positioned to capture the respective agent's undistorted audible input 104A, 104B.

Using a linear mixing model, agent 1's audio input signal ($y_1(n)$) includes two components: an audible audio component that includes agent 1's audible input 104A ($x_1(n)$), which will dominate due to the proximity of agent 1 to the audio input device 108A; and a noise component $a_1x_2(n)$, which includes agent 2's audible input 104B ($x_2(n)$) scaled by a factor ($a_1$) to reflect the distance between agent 2's audio input device 108B and agent 1's audio input device 108A. Similarly, agent 2's audio input signal ($y_2(n)$) includes two components: an audible audio component that includes agent 2's audible input 104B ($x_2(n)$), which will dominate due to the proximity of agent 2 to the audio input device 108B; and a noise component $a_2x_1(n)$, which includes agent 1's audible input 104A ($x_1(n)$) scaled by a factor ($a_2$) to reflect the distance between agent 1's audio input device 108A and agent 2's audio input device 108B. These two relationships may be represented in the form of a linear mixing model, represented as:

$$y_1(n)=x_1(n)+a_1x_2(n) \tag{1}$$

$$y_2(n)=x_2(n)+a_2x_1(n) \tag{2}$$

The linear mixing model defined by equations (1) and (2) may be represented in matrix form as follows:

$$\begin{bmatrix} y_1(n) \\ y_2(n) \end{bmatrix} = \begin{bmatrix} 1 & a_1 \\ a_2 & 1 \end{bmatrix} \begin{bmatrix} x_1(n) \\ x_2(n) \end{bmatrix} \tag{3}$$

The matrix in equation (3) may be represented in shorthand as follows:

$$Y=AX \tag{4}$$

The task for the audio signal processing circuit 120 is to estimate a demixing matrix, W, that separates the audible audio component of agent 1's audio input signal 110A and the audible audio component of agent 2's audio input signal 110B from the noise component present in each audio input signal 110 up to an indeterminate permutation and scaling, i.e.:

$$Z=WY \tag{5}$$

A commonly exploited property of audio input signals 110 for separation is their statistical independence. This property underpins numerous Blind Sound Source Separation techniques that identify the demixing matrix W by optimizing an objective/cost function that measures the independence of the set of mixtures. This approach may also be interpreted as decomposing a multivariate signal into its independent components, giving rise to the term Independent Component Analysis (ICA). Besides ICA, numerous other Blind Sound Source Separation techniques have been devised that exploit alternative, equally generic, properties of audio input signals 110 to identify the demixing matrix W.

Typically, such mixing problems such as that described in equations (1) and (2) would include four unknowns $x_1$, $x_2$, $a_1$, and $a_2$. However, in input signal source locations 102 such as depicted in FIG. 1 (e.g., a call center), the audible inputs 104A and 104B are known, thereby reducing the number of unknowns by one-half. Such will be true for any number of audible inputs 104A-104*n* (i.e., oral or audible conversations) provided by a corresponding number of agents 112A-112*n*. Such may be exploited to reduce the search space of the optimization problem leading to a better conditioned problem. Moreover, the structure of the mixing matrix A can be exploited to reduce the computational load placed on the audio signal processing circuit 120. These properties demonstrate the advantage of the audio signal processing circuit 120 using a Blind Sound Source Separation technique in a scenario where a number of sources 112A-112*n* located within a relatively small space provide a number of audible inputs 104A-104*n*, such as a call center where a number of agents 112A-112*n* may be positioned in close proximity and the noise component in any given audio input signal 110 consists primarily of ambient noise 106 formed by the audible inputs 104 of at least a portion of the other agents 112 present in the call center.

FIG. 2B depicts an example sound separation using a Blind Sound Source Separation technique. Agent 1's example audible input 104A ($x_1(n)$) is depicted in graph 202A, agent 2's example audible input 104B ($x_2(n)$) is depicted in graph 202B. The example noise signal 106A ($a_1x_2(n)$) captured by agent 1's audio input device 108A is depicted in graph 204A—with the scaling factor $a_1$=0.25. The example noise signal 106B ($a_2x_1(n)$) captured by agent 2's audio input device 108B is depicted in graph 204B—with the scaling factor $a_2$=0.25. The audio input signal 110A that includes the audible input 104A and the noise signal 106A is depicted in graph 206A. The audio input signal 110B that includes the audible input 104B and the noise signal 106B is depicted in graph 206B.

In embodiments, the audio signal processing circuit 120 may employ a Fast Independent Component Analysis (Fast ICA) to identify the demixing matrix W. The audio signal processing circuit 120 generates an audible output 142A that is depicted in graph 208A. Audible output 142A demonstrates a high correlation to the original audible input 104A provided by agent 1. Contemporaneously, the audio signal processing circuit 120 also generates an audible output 142B that is depicted in graph 208B. Audible output 142B also demonstrates a high correlation to the original audible input 104B provided by agent 2. The Fast ICA applied by the audio signal processing circuit 120 effects a near-complete separation of audio inputs 104A and 104B. Advantageously, the relatively clean audible outputs 142A and 142B may be provided to customers 146A and 146B, improving call quality and customer satisfaction.

In some implementations, the audio signal processing circuit 120 may accommodate the effect of permutation ambiguity by correlating each independent component with each mixture and selecting the source demonstrating the greatest correlation. The audio signal processing circuit 120 may accommodate the effect of scaling ambiguity by simply scaling the component to plus and minus one.

Figure 3:
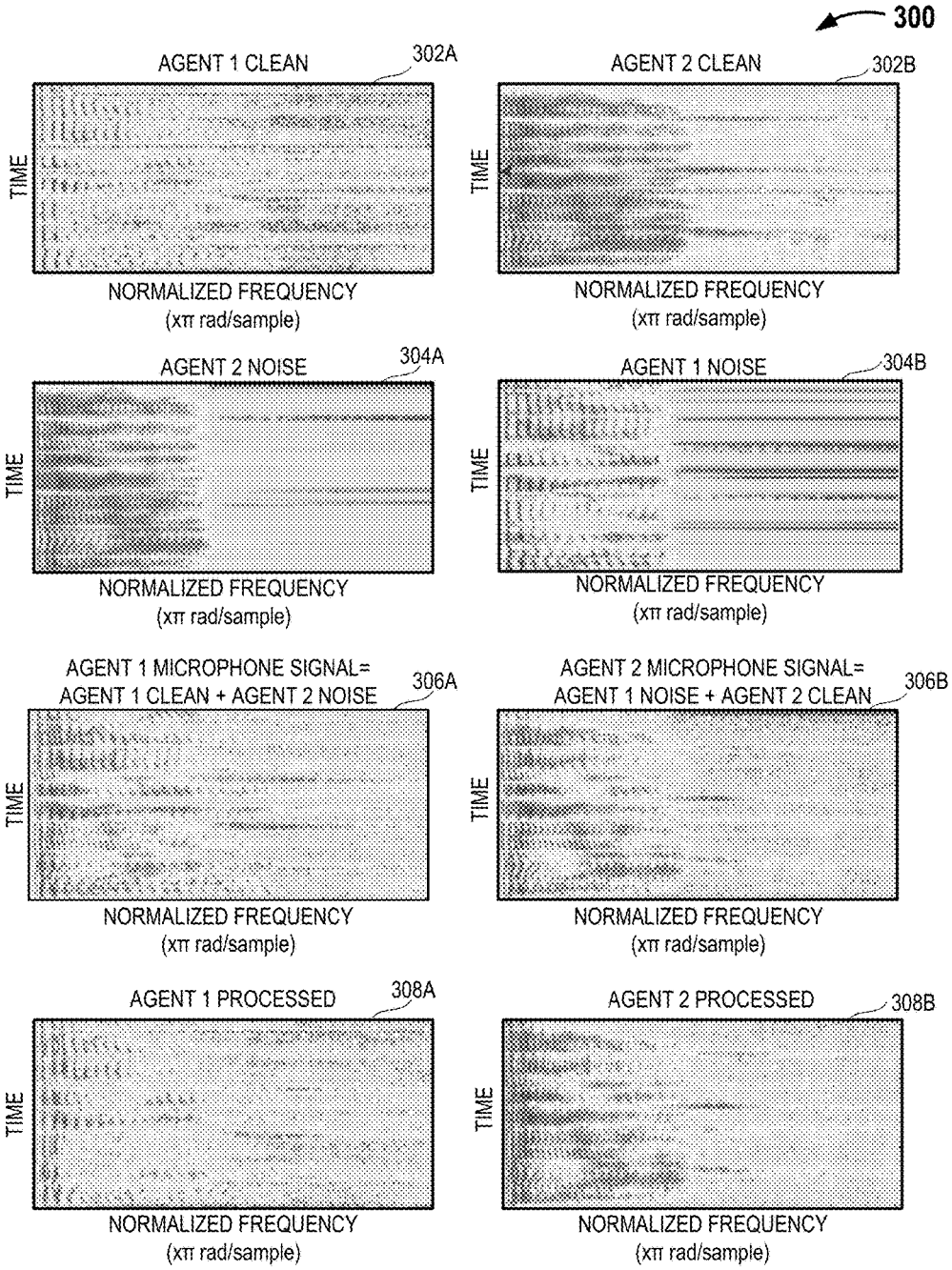
FIG. 3 includes several plots demonstrating the performance of an example audio signal processing system such as that depicted in FIG. 1, in accordance with at least one embodiment of the present disclosure.

FIG. 3 provides a series of normalized frequency versus time plots demonstrating the accuracy of a Blind Sound Source Separation (BSSS) technique applied to convolutedly mixed signals such as a number of audio input signals 110 generated in a source location 102 such as the call center depicted in FIG. 2A, in accordance with at least one embodiment of the present disclosure. In the case of convolutive mixing, the audio signal processing circuit 120 incorporates the effect of reflections (e.g., echoes) and other sources of spectral coloration, such as occlusion between the agent 112 and the audio input device 108. In some implementations, the audio signal processing circuit 120 may apply one or more filters or similar signal processing devices such as a Finite Impulse Response (FIR) filter to each of the audio input signals 110. For input signal source locations 102 having a large number of audible inputs 104 within a relatively constrained area, such as the call center depicted in FIG. 2A. In such implementations, the following convolutive mixing model applies:

$$\begin{bmatrix} y_1(n) \\ y_2(n) \end{bmatrix} = \begin{bmatrix} 1 & h_1^T \\ h_2^T & 1 \end{bmatrix} \begin{bmatrix} x_1(n) \\ x_2(n) \end{bmatrix} \tag{3}$$

In the above matrix, $h_1$ and $h_2$ represent vectors that contain the coefficients of FIR filters that capture the effect of reflections and other sources of spectral coloration on example audible input 104A ($x_1(n)$) and example audible input 104B ($x_2(n)$). Given the likelihood of echoes and other sources of spectral coloration, the audio signal processing circuit 120 may apply a convolutive mixing model for input signal source locations 102 demonstrating a high concentration of audible inputs 104, such as a call center.

Generally, the determination of a time domain Blind Sound Source Separation technique solution for convolutive mixing is inherently more difficult than a linear Blind Sound Source Separation technique due to the greater number of parameters in the convolutive Blind Sound Source Separation technique. In embodiments, multiple independent runs of the Blind Sound Source Separation technique may be needed to achieve a good separation using the convolutive Blind Sound Source Separation technique. However, in input signal source locations 102 such as the call center depicted in FIG. 2A, the number of unknown parameters is halved based on the known audio input signals 110. The reduction in unknown parameters provides a better conditioned cost/function space for the audio signal processing circuit 120.

In at least some implementations, the audio signal processing circuit 120 may apply a Blind Sound Source Separation technique by transforming the problem into the time/frequency domain and separating each frequency bin separately. Such an approach transforms the problem from a convolutive mixing problem to a linear mixing problem in each frequency bin. In such implementations, the audio signal processing circuit 120 may estimate a demixing matrix W for each frequency bin. The audio signal processing circuit 120 may then use heuristics related to the structure of the audible inputs 104 in the time/frequency domain to solve the permutation problem. In some implementations, the audio signal processing circuit 120 may perform the separation of the audible audio component in each of the audio input signals 110 in the time/frequency domain via Independent Component Analysis.

In another example embodiment that takes convolutive mixing of echoes and spectral noise into consideration, The time/frequency response of agent 1's example audible input 104A ($x_1(n)$) is depicted in graph 302A, and the time/frequency response of agent 2's example audible input 104B ($x_2(n)$) is depicted in graph 302B. The example noise signal 106A ($a_1x_2(n)$) that includes audible input 104A ($x_1(n)$) and 104B ($x_2(n)$) convolutively mixed together. The filters $h_1$ and $h_2$ were set to a fiftieth order low-pass filters and applied to each of the audible input signals 104A and 104B to replicate the effects of echoing and occlusion. The time/frequency response of the resultant noise signal 106A captured by agent 1's audio input device 108A is depicted in time/frequency graph 304A and the noise signal 106B captured by agent 2's audio input device 108B is depicted in graph time/frequency 304B. The time/frequency response of audio input signal 110A that includes the audible input 104A and the noise signal 106A is depicted in time/frequency graph 306A. The time/frequency response of audio input signal 110B that includes the audible input 104B and the noise signal 106B is depicted in time/frequency graph 306B.

In embodiments, the audio signal processing circuit 120 may employ a Fast Independent Component Analysis (Fast ICA) on each of the frequency bins to identify a demixing matrix W for each respective one of the frequency bins. The audio signal processing circuit 120 combines the demixed output from each respective one of the frequency bins using heuristics related to spectral clues present in each of the audible inputs 104A-104*n*, such as the level of spectral correlation between the each of the audible inputs 104A-104*n*. The audio signal processing circuit 120 may then generate a time domain waveform using an inverse Fast Fourier Transform (IFFT) and the overlap and add approach. The time/frequency response of the resultant audible output signal 142A recovered by the audio signal processing circuit 120 from audio input signal 110A is depicted in time/frequency graph 308A. The time/frequency response of the resultant audible output signal 142B recovered by the audio signal processing circuit 120 from audio input signal 110B is depicted in time/frequency graph 308B. Audible output 142A produced by the audio signal processing circuit 120 demonstrates a high correlation to the original audible input 104A provided by agent 1 as depicted in graph 304A. Audible output 142B produced by the audio signal processing circuit 120 also demonstrates a high correlation to the original audible input 104B provided by agent 2 as depicted in graph 304B. While the correlation achieved by the audio signal processing circuit 120 between audible input 104A and audible output 142A and the correlation between audible input 104B and audible output 142B may be slightly lower than the linear mixing case in FIG. 2B, the audio signal processing circuit 120 removes a significant amount of spectral energy contained in the noise component of the audio input signals 110A and 110B, allowing for a significant reduction in background noise in the resultant audible outputs 142A and 142B.

In some implementations, the audio signal processing circuit 120 may employ a frame-by-frame based stochastic gradient descent algorithm to minimize the cost function. In at least some implementations, the audio signal processing circuit 120 may recursively estimate the probability density functions used by the cost function using a Parzen window (Kernel Density estimation) over previous samples of the audio input signals 110.

Figure 4:
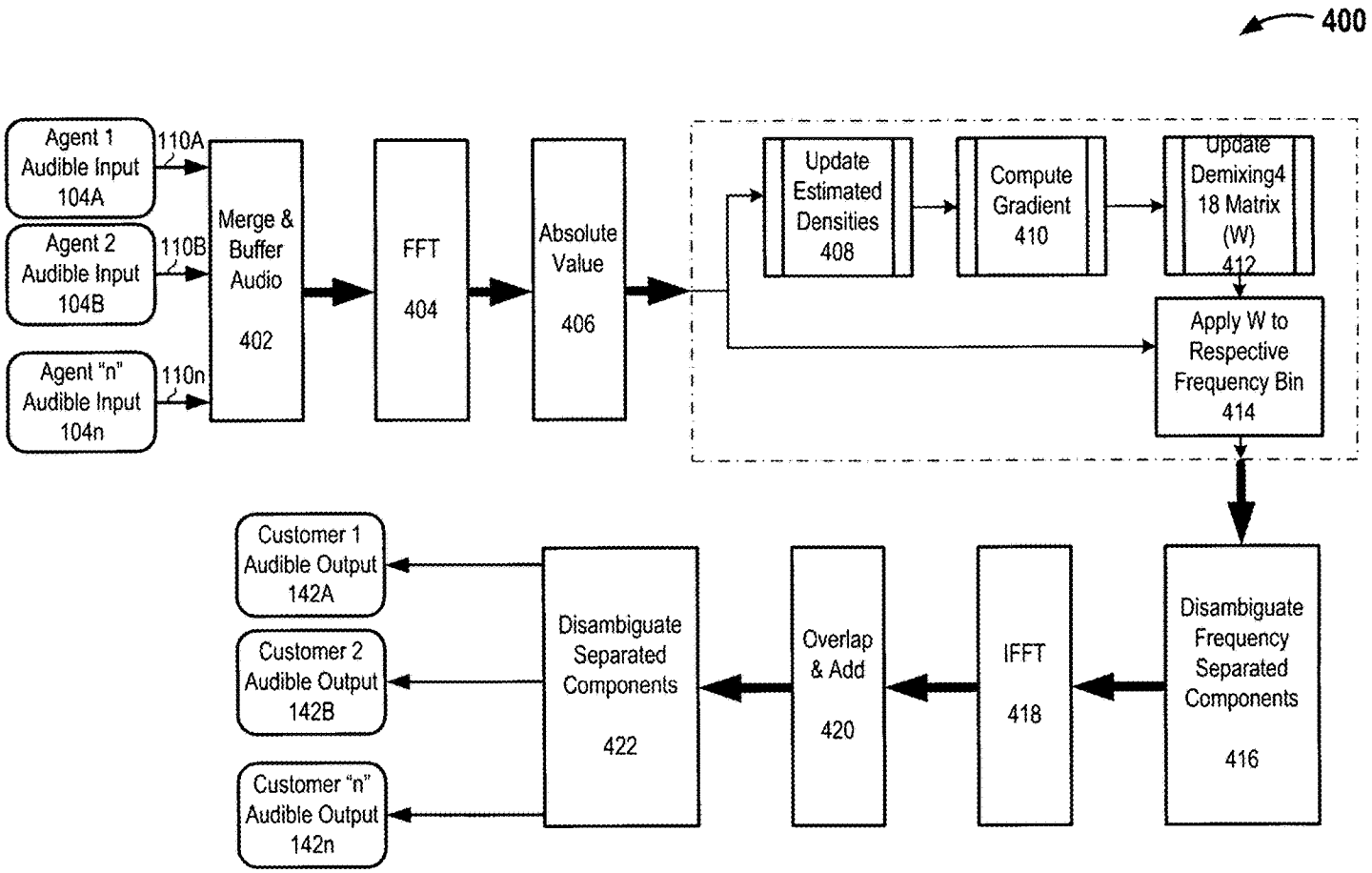
FIG. 4 is a schematic of another illustrative audio signal processing system, in accordance with at least one embodiment of the present disclosure.

FIG. 4 is a schematic of another illustrative audio signal processing system 400 in which an audio signal processing signal 120 implements a Blind Sound Source Separation technique, in accordance with at least one embodiment of the present disclosure. As depicted in FIG. 4, lighter arrows denote individual signals while heavier arrows denote two or more combined signals. In embodiments, the audio signal processing circuit 120 may include a frame buffer 402 that buffers a plurality of incoming signals 110A-110*n* from each of a respective plurality of agents 112A-112*n* into a number of contiguous frames and then merges the number of frames to create a multidimensional frame in which rows may correspond to frequency bins and columns may correspond to audio input signals.

The audio signal processing circuit 120 may apply a Fast Fourier Transform to each column of the multidimensional frame using a Fast Fourier Transform (FFT) module 404. After obtaining the FFT for each column of the multidimensional frame, the audio signal processing circuit 120 may use an absolute value module 406 to obtain data representative of the absolute value of each element in the multidimensional array to provide a multidimensional frame of spectral magnitude components. The audio signal processing circuit 120 may use the multidimensional frame of spectral magnitude components provided by the absolute value module 406 as an input for a Blind Sound Source Separation technique performed on each row (i.e., frequency bin).

For each frequency bin, the audio signal processing circuit 120 may update the estimates of the probability distribution needed to compute the gradient using a probability density estimating module 408. In embodiments, the audio signal processing circuit 120 may use a histogram-based probability distribution technique or a Kernel density estimation technique.

For each frequency bin, the audio signal processing circuit 120 may compute the gradient for the stochastic gradient descent method using a gradient determination module 410. The audio signal processing circuit 120 may then scale the gradient and add the scaled gradient to the demixing matrix W for the respective frequency bin using a matrix updating module 412.

For each frequency bin, the audio signal processing circuit 120 applies the demixing matrix to the frequency bin data to demix the audio input signals 110 using a demixing module 414. The audio signal processing circuit 120 matches the separated frequency components using spectral clues such as common onset/offset using a frequency disambiguation module 416.

The audio signal processing circuit 120 then performs an inverse Fast Fourier Transform (IFFT) on the matched frequency components using an IFFT module 418. Using an addition module 420, the audio signal processing circuit 120 may then overlap and add the frames to resynthesize all of the audible signals 142 in an output frame. In embodiments, the audio signal processing circuit 120 disambiguates the audible signals 142 in the output frame and matches the disambiguated output signals 142 to the original agent's audible input 104. In embodiments, using a disambiguation module 422, the audio signal processing circuit 120 may match the disambiguated output signals 142 to the original agent's audible input 104 using the maximum correlation between separated audible output 142 components and audible input 104 components. The enhanced audible outputs 142 are then provided to customers 146.

Figure 5:
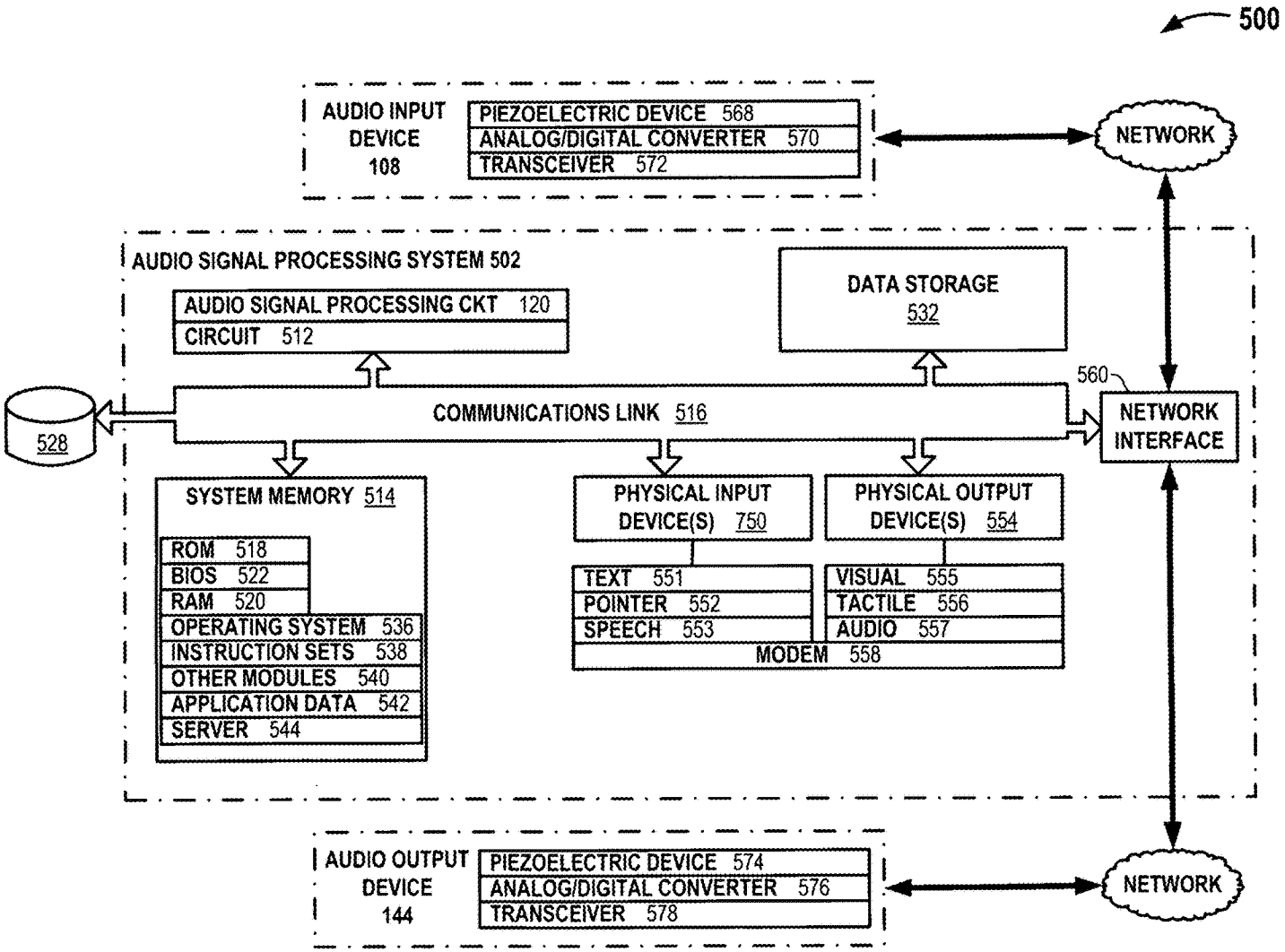
FIG. 5 is a block diagram of an illustrative audio signal processing system, in accordance with at least one embodiment of the present disclosure.

FIG. 5 and the following discussion provide a brief, general description of the components forming an illustrative audio signal processing system 700 that includes a virtual audio signal processing circuit 120, an audio input device 108, and an audio output device 144 in which the various illustrated embodiments can be implemented. Although not required, some portion of the embodiments will be described in the general context of machine-readable or computer-executable instruction sets, such as program application modules, objects, or macros being executed by the audio signal processing circuit 120. Those skilled in the relevant art will appreciate that the illustrated embodiments as well as other embodiments can be practiced with other circuit-based device configurations, including portable electronic or handheld electronic devices, for instance smartphones, portable computers, wearable computers, microprocessor-based or programmable consumer electronics, personal computers ("PCs"), network PCs, minicomputers, mainframe computers, and the like. The embodiments can be practiced in distributed computing environments where tasks or modules are performed by remote processing devices, which are linked through a communications network. In a distributed computing environment, program modules may be located in both local and remote memory storage devices.

The audio signal processing system 502 may take the form of any number of circuits, some or all of which may include electronic and/or semiconductor components that are disposed partially or wholly in a PC, server, or other computing system capable of executing machine-readable instructions. The audio signal processing system 502 may include any number of circuits 512, and may, at times, include a communications link 516 that couples various system components including a system memory 514 to the number of circuits 512. The audio signal processing system 502 will at times be referred to in the singular herein, but this is not intended to limit the embodiments to a single system, since in certain embodiments, there will be more than audio signal processing system 502 that may incorporate any number of collocated or remote networked circuits or devices.

Each of the number of circuits 512 may include any number, type, or combination of devices. At times, each of the number of circuits 512 may be implemented in whole or in part in the form of semiconductor devices such as diodes, transistors, inductors, capacitors, and resistors. Such an implementation may include, but is not limited to any current or future developed single- or multi-core processor or microprocessor, such as: on or more systems on a chip (SOCs); central processing units (CPUs); digital signal processors (DSPs); graphics processing units (GPUs); application-specific integrated circuits (ASICs), field programmable gate arrays (FPGAs), and the like. Unless described otherwise, the construction and operation of the various blocks shown in FIG. 5 are of conventional design. As a result, such blocks need not be described in further detail herein, as they will be understood by those skilled in the relevant art. The communications link 516 that interconnects at least some of the components of the audio signal processing system 502 may employ any known bus structures or architectures.

The system memory 514 may include read-only memory ("ROM") 518 and random access memory ("RAM") 520. A portion of the ROM 518 may contain a basic input/output system ("BIOS") 522. The BIOS 522 may provide basic functionality to the audio signal processing system 502, for example by causing at least some of the number of circuits 512 to load one or more machine-readable instruction sets that cause at least a portion of the number of circuits 512 to function as a dedicated, specific, and particular machine, such as the audio signal processing circuit 120. The audio signal processing system 502 may include one or more communicably coupled, non-transitory, data storage devices 532. The one or more data storage devices 532 may include any current or future developed non-transitory storage devices. Non-limiting examples of such data storage devices 532 may include, but are not limited to any current or future developed nontransitory storage appliances or devices, such as one or more magnetic storage devices, one or more optical storage devices, one or more solid-state electromagnetic storage devices, one or more electroresistive storage devices, one or more molecular storage devices, one or more quantum storage devices, or various combinations thereof. In some implementations, the one or more data storage devices 532 may include one or more removable storage devices, such as one or more flash drives or similar appliances or devices.

The one or more storage devices 532 may include interfaces or controllers (not shown) communicatively coupling the respective storage device or system to the communications link 516, as is known by those skilled in the art. The one or more storage devices 532 may contain machine-readable instruction sets, data structures, program modules, data stores, databases, logical structures, and/or other data useful to the audio signal processing circuit 120. In some instances, one or more external storage devices 528 may be communicably coupled to the audio signal processing circuit 520, for example via communications link 516 or one or more tethered or wireless networks.

Machine-readable instruction sets 538 and other modules 540 may be stored in whole or in part in the system memory 514. Such instruction sets 538 may be transferred from one or more storage devices 532 and/or one or more external storage devices 528 and stored in the system memory 514 in whole or in part when executed by the audio signal processing circuit 120. The machine-readable instruction sets 538 may include instructions or similar executable logic capable of providing the live virtual machine migration functions and capabilities described herein.

For example, one or more machine-readable instruction sets 538 may cause the audio signal processing circuit 120 to merge and buffer a number of audio input signals 110 from a respective number of audio input devices 108. One or more machine-readable instruction sets 538 may cause the audio signal processing circuit 120 to perform a Blind Sound Source Separation technique that reduces or otherwise removes at least a portion of the noise component from each of the audio input signals 110. One or more machine-readable instruction sets 538 may cause the audio signal processing circuit 120 to perform a Blind Sound Source Separation technique that outputs a reduced noise audio output 142 that includes at least the audible audio component of an audio input signal 110 to a respective audio output device 144.

Users of the audio signal processing system 502 may provide, enter, or otherwise supply commands (e.g., acknowledgements, selections, confirmations, and similar) as well as information (e.g., subject identification information, color parameters) to the audio signal processing system 502 using one or more communicably coupled physical input devices 550 such as one or more text entry devices 551 (e.g., keyboard), one or more pointing devices 552 (e.g., mouse, trackball, touchscreen), and/or one or more audio input devices 553. Some or all of the physical input devices 550 may be physically and communicably coupled to the audio signal processing system 502.

The audio signal processing system 502 may provide output to users via a number of physical output devices 554. In at least some implementations, the number of physical output devices 554 may include, but are not limited to, any current or future developed display devices 555; tactile output devices 556; audio output devices 557, or combinations thereof. Some or all of the physical input devices 550 and some or all of the physical output devices 554 may be communicably coupled to the audio signal processing system 502 via one or more tethered interfaces, hardwire interfaces, or wireless interfaces.

For convenience, the network interface 560, the one or more circuits 512, the system memory 514, the physical input devices 550 and the physical output devices 554 are illustrated as communicatively coupled to each other via the communications link 516, thereby providing connectivity between the above-described components. In alternative embodiments, the above-described components may be communicatively coupled in a different manner than illustrated in FIG. 5. For example, one or more of the above-described components may be directly coupled to other components, or may be coupled to each other, via one or more intermediary components (not shown). In some embodiments, all or a portion of the communications link 516 may be omitted and the components are coupled directly to each other using suitable tethered, hardwired, or wireless connections.

The audio input device 108 may include one or more piezoelectric devices 568 or any other current or future developed transducer technology capable of converting an audible input 104 to an analog or digital signal containing information or data representative of the respective audible input 104. In embodiments where the one or more piezoelectric devices 568 include one or more devices providing an analog output signal, the audio input device 108 may include one or more devices or systems, such as one or more analog-to-digital (A/D) converters 570 capable of converting the analog output signal to a digital output signal that contains the data or information representative of the respective audible input 104. The audio input device 108 may also include one or more transceivers 572 capable of outputting the signal provided by the piezoelectric device 568 or the A/D converter 570 to the audio signal processing system 502.

The audio output device 144 may include one or more receivers or one or more transceivers 578 capable of receiving an audio output signal from the audio signal processing system 502. In embodiments, the audio output device 144 may receive from the audio signal processing system 502 either an analog signal containing information or data representative of the audio output signal or a digital signal containing information or data representative of the audio output signal. In embodiments where the audio output device 144 receives a digital output signal from the audio signal processing system 502, the audio output device 108 may include one or more digital-to-analog (D/A) converters 576 capable of converting the digital signal received from the audio signal processing system 502 to an analog signal. In some implementations, the audio output device 144 may include a speaker or similar audio output device capable of converting the audio output signal received from the audio signal processing system 502 to an audible output 142.

Figure 6:
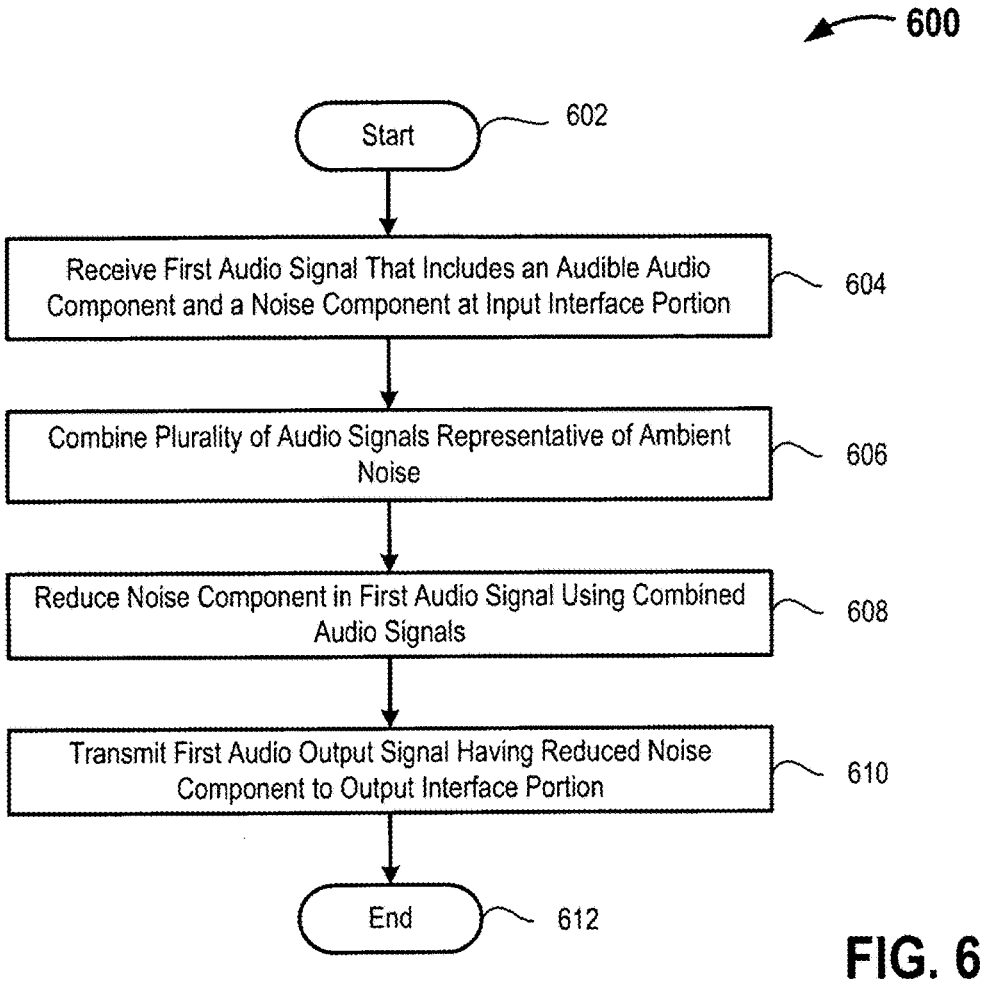
FIG. 6 is a high-level flow diagram of an illustrative audio signal processing method, in accordance with at least one embodiment of the present disclosure.

FIG. 6 is a high-level logic flow diagram of an illustrative audio signal processing method 600, in accordance with at least one embodiment of the present disclosure. The audio signal processing method 600 may be used in environments in which an audible audio component, such as a voice, may be mixed with a noise component, such as environmental ambient noise—for example, from other nearby conversations. Such environments may exist in locales or locations where a large number of people have gathered. Such environments may exist in locales or locations where noise producing devices and/or machinery are operated. Such environments may exist in locales or locations such as call centers or customer service centers. In such instances, each of the audio input signals 110 includes a noise component and an audible audio component. The audio signal processing circuit 120 removes at least a portion of the noise component from each of the audio input signals 110 and outputs an audio output 142 having a reduced, or even eliminated, noise component. The method 600 commences at 602.

At 604, the audio signal processing circuit 120 receives an audio input signal 110 that includes both an audible audio component and a noise component at an input interface portion. In embodiments, the audio component of each audio input signal 110 may include an audible input 104 provided by an agent 112, call center operator 112, or similar. In embodiments, the noise component of each audio input signal 110 may include ambient noise in the form of extraneous conversations from other agents or call center operators 112 proximate the agent or call center operator 112 providing the respective audible input 104.

At 606, the audio signal processing circuit 120 merges or otherwise combines a number of audio input signals 110 received from a number of audio input devices 108 to provide a combined audio input signal. Advantageously, the combined audio input signal includes audible inputs 104 from each of the agents 112 which comprise the components forming the noise component in each of the audio input signals 110.

At 608, the audio signal processing circuit 120 reduces the noise component in each of the received audio input signals 110 using data or information included in the combined audio signal. In embodiments, the noise component may be reduced using one or more techniques such as a Blind Sound Source Separation technique.

At 610, the audio signal processing circuit 120 communicates or otherwise transmits an audio output signal to an output interface. For each received audio input signal 110, the audio signal processing circuit 120 communicates a corresponding audio output signal to an output interface portion. The audio output signal for each receive audio input signal 110 includes data or information representative the audible audio component in the originally received audio input signal 110 and a reduced noise component in the originally received audio input signal 110. The method 600 concludes at 612.

Figure 7:
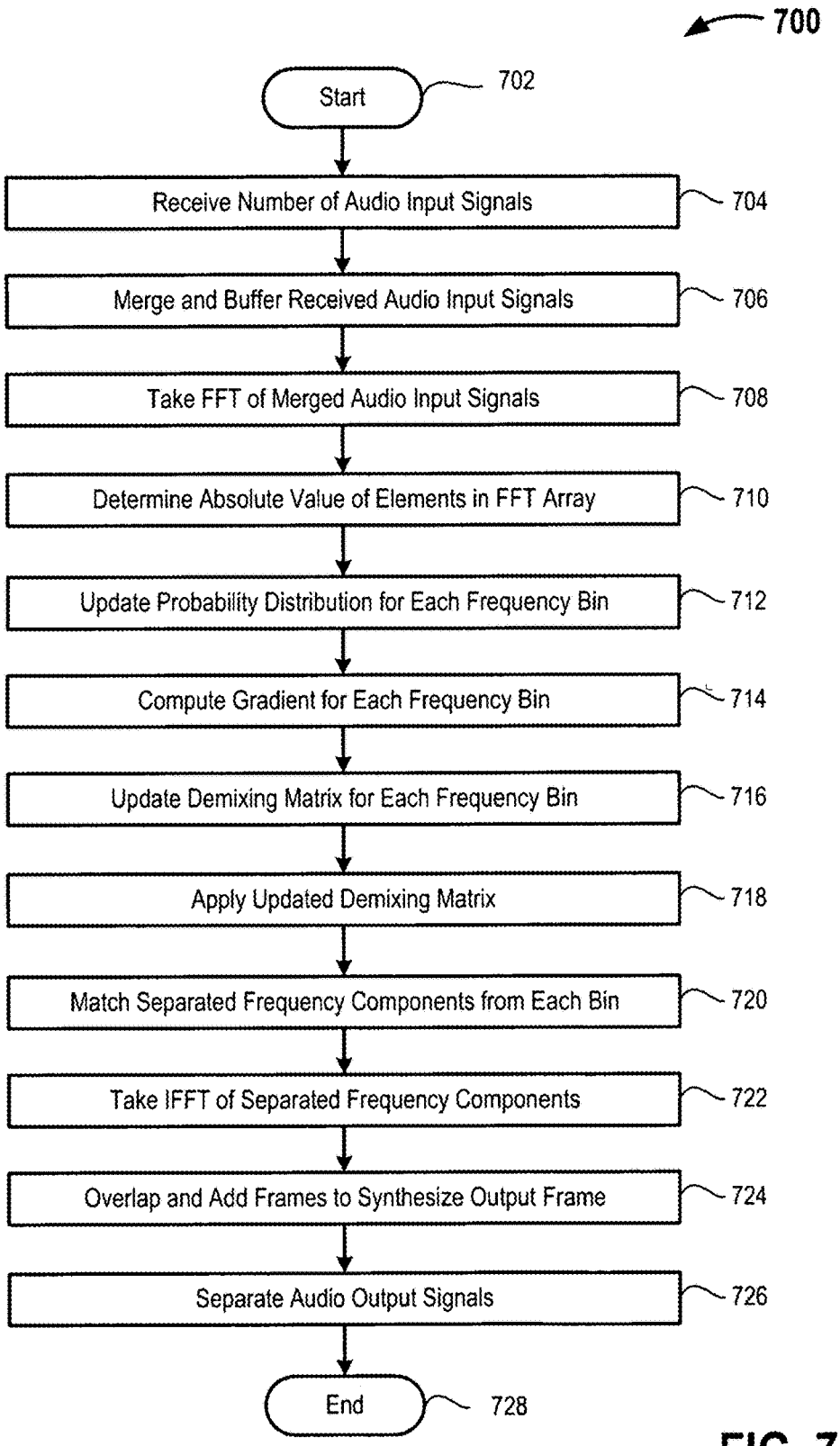
FIG. 7 is a high-level flow diagram of an illustrative Blind Sound Source Separation technique that may be used by an audio signal processing system to reduce or remove noise from a plurality of audio input signals, in accordance with at least one embodiment of the present disclosure.

FIG. 7 is a high-level logic flow diagram of an illustrative Blind Sound Source Separation method 700 that may be employed by the audio signal processing circuit 120 to reduce or eliminate the noise component in each of the audio input signals 110 received by the audio signal processing circuit 120, in accordance with at least one embodiment of the present disclosure. The method 700 commences at 702.

At 704, the audio signal processing circuit 120 receives a number of audio input signals 110 from a respective number of agents 112 in a call center or similar input signal source location 102. Each of the audio input signals 110 include an audible audio component and a noise component.

At 706, the audio signal processing circuit 120 buffers a number of audio input signals 110 into a continuous frame. In embodiments, at least a portion of the frames may be merged to create a multidimensional frame in which rows correspond to frequency bins and columns correspond to each respective one of the audio input signals 110.

At 708, the audio signal processing circuit 120 takes the Fast Fourier Transform (FFT) of each column in the multidimensional frame.

At 710, the audio signal processing circuit 120 determines the absolute value of each element in the multidimensional array to produce a multidimensional frame of spectral magnitude components.

At 712, the audio signal processing circuit 120 performs a Blind Sound Source Separation technique by updating the estimates of probability distributions to compute the gradient for each of the frequency bins. In some implementations, the audio signal processing circuit 120 applies techniques such as a simple histogram based technique or a Kernel density estimation.

At 714, the audio signal processing circuit 120 computes the gradient for use in a stochastic gradient descent method for each frequency bin.

At 716, the audio signal processing circuit 120 scales the gradient for each frequency bin and updates the demixing matrix, W, for each frequency bin by adding the gradient to the demixing matrix W. Such updating advantageously permits the audio signal processing circuit 120 to adapt to changes in the ambient noise in the input signal source location which will alter the noise component in each of the received audio input signals 110.

At 718, the audio signal processing circuit 120 demixes at least the audible audio component of each of the received audio input signals 110 by applying the updated matrix determined at 716.

At 720, the audio signal processing circuit 120 matches at least the audible audio component of each of the received audio input signals 110 using spectral clues such as common onset/offset.

At 722, the audio signal processing circuit 120 takes the Inverse Fast Fourier Transform (IFFT) of the matched frequency frames.

At 724, the audio signal processing circuit 120 overlaps and adds frequency frames to resynthesize at least the audible audio component of the audio input signal 110.

At 726, the audio signal processing circuit 120 separates the resynthesized audio input signals 110 and matches each of the resynthesized audio input signals 110 to the original agent's audible input 104. In embodiments, the audio signal processing circuit 120 may use a correlation between each separated component and each original audible input 104. The enhanced audio output signals (i.e., audio output having a reduced noise component) may be forwarded to each customer 146. The method 700 concludes at 728.

The following examples pertain to further embodiments. The following examples of the present disclosure may comprise subject material such as devices, systems, and methods that facilitate the removal of at least a portion of a noise component from each of a plurality of audio input signals 110 by an audio signal processing system. The audio signal processing system is able to remove at least a portion of the noise component from each of the audio input signals based at least in part on the proximity of the agents 112 in an input signal source location 102 and the receipt of audio input signals 110 from at least a portion of the agents 112 in the input signal source location 112.

According to example 1, there is provided an audio signal processing controller. The audio signal processing controller may include an input interface portion, an output interface portion, and at least one audio processing circuit communicably coupled to the input interface portion, the output interface portion, and at least one storage device. The at least one storage device may include machine-readable instructions that, when executed by the at least one audio processing circuit, cause the at least one audio processing circuit to, for each of a plurality of physically proximate audible audio sources: receive, at the input interface portion, a first audio signal that includes at least an audible audio component and a noise component; combine the audio signals from the remaining physically proximate audible audio sources; reduce the noise component in the first audio signal using the combined audio signals from the remaining physically proximate audio sources; and provide the first audio signal with the reduced noise component as an output audio signal at the output interface portion.

Example 2 may include elements of example 1 where the machine-readable instructions that cause the at least one audio processing circuit to reduce the noise component in the first audio signal using the combined audio signals from the remaining physically proximate audio sources may cause the at least one audio processing circuit to apply a Blind Sound Source Separation (BSSS) technique to reduce the noise component in the first audio signal using the combined audio signals from the remaining physically proximate audio sources.

Example 3 may include elements of example 2 where the machine-readable instructions that cause the at least one audio processing circuit to apply a Blind Sound Source Separation (BSSS) technique to reduce the noise component in the first audio signal using the combined audio signals from the remaining physically proximate audio sources, may further cause the at least one audio processing circuit to apply a convolutive BSSS technique to reduce the noise component in the first audio signal using the combined audio signals from the remaining physically proximate audio sources.

Example 4 may include elements of example 1 where the machine-readable instructions that cause the at least one audio processing circuit to reduce the noise component in the first audio signal using the combined audio signals from the remaining physically proximate audio sources, may further cause the at least one audio processing circuit to apply an Independent Component Analysis (ICA) to reduce the noise component in the first audio signal using statistically independent, combined audio signals from the remaining physically proximate audio sources.

Example 5 may include elements of example 4 where the machine-readable instructions that cause the at least one audio processing circuit to apply an Independent Component Analysis (ICA) to reduce the noise component in the first audio signal using statistically independent, combined audio signals from the remaining physically proximate audio sources, may further cause the at least one audio processing circuit to, for each of the plurality of physically proximate audible audio sources: convert the combined audio signals from the remaining physically proximate audible audio sources from a time domain to a number of frequency bins in a time-frequency domain; determine a demixing matrix for each of the frequency bins; and separate the first audio signal from the combined audio signals from the remaining physically proximate audible audio sources.

Example 6 may include elements of example 1 where the machine-readable instructions that cause the at least one audio processing circuit to receive, at the input interface portion, a first audio signal that includes at least an audible audio component and a noise component, may cause the at least one audio processing circuit to receive a first audio in which the audible audio component includes at least a first voice call audible audio signal.

Example 7 may include elements of example 1 where the machine-readable instructions that cause the at least one audio processing circuit to combine the audio signals from the remaining physically proximate audible audio sources, may cause the at least one audio processing circuit to combine audio signals from the remaining physically proximate audible audio sources, the combined audio signals including, at least in part, an audible voice call audio signal from each of at least some of the remaining physically proximate audible audio sources.

According to example 8, there is provided an audio signal processing method. The method may include receiving a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source. The method may further include combining, by at least one audio processing circuit communicably coupled to the input interface portion, a plurality of audio signals, each of the audio signals representative of the audible ambient noise generated by a respective one of the plurality of audio sources physically proximate the first audio source. The method may additionally include reducing, by the at least one audio processing circuit, the noise component in the first audio signal using the combined audio signals and transmitting, by the at least one audio processing circuit, a first audio output signal having a reduced noise component to a communicably coupled output interface portion.

Example 9 may include elements of example 8 where combining a plurality of audio signals, each of the audio signals representative of the audible ambient noise generated by a respective one of the plurality of audio sources physically proximate the first audio source may include combining, by the at least one audio processing circuit, a plurality of audio signals, each of the audio signals representative of the audible ambient noise received by a respective microphone used by each of the plurality of audio sources physically proximate the first audio source.

Example 10 may include elements of example 8 where receiving a first audio signal that includes an audible audio component generated by a first audio source and an ambient noise component may include receiving a first audio signal from a single microphone used by the first audio source via an input interface portion, the first audio signal including the audible audio component generated by the first audio source and the ambient noise component.

Example 11 may include elements of example 10 where receiving a first audio signal at an input interface portion, the first audio signal including an audible audio component generated by a first audio source and an ambient noise component may include receiving a first audio signal at an input interface portion, the first audio signal including an audible audio component that includes at least a first voice call audible audio signal generated by a first audio source and an ambient noise component.

Example 12 may include elements of example 8 where receiving a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source may include receiving the first audio signal at the input interface portion, the first audio signal including an ambient noise component including an audio signal representative of an audible ambient noise including at least a voice call sound produced by the respective audible audio source disposed physically proximate the first audio source.

Example 13 may include elements of example 8 where reducing the noise component in the first audio signal using the combined ambient audio signals may include applying, by the at least one audio processing circuit, a Blind Sound Source Separation (BSSS) technique to reduce the noise component in the first audio signal using the combined audio signals from the plurality of audio sources physically proximate the first audio source.

Example 14 may include elements of example 13 where applying a Blind Sound Source Separation (BSSS) technique to reduce the noise component in the first audio signal using the combined audio signals from the remaining physically proximate audio sources may include applying, by the at least one audio processing circuit, a convolutive BSSS technique to reduce the noise component in the first audio signal using the combined audio signals from the plurality of audio sources physically proximate the first audio source.

Example 15 may include elements of example 8 where reducing the noise component in the first audio signal using the combined audio signals from the plurality of physically proximate audio sources may include applying, by the at least one audio processing circuit, an Independent Component Analysis (ICA) to reduce the noise component in the first audio signal using statistically independent, combined audio signals from the plurality of audio sources physically proximate the first audio source.

Example 16 may include elements of example 15 where applying an Independent Component Analysis (ICA) to reduce the noise component in the first audio signal using statistically independent, combined audio signals from the plurality of audio sources physically proximate the first audio source may include, for each of the plurality of audio sources physically proximate the first audio source: converting, by the at least one audio processing circuit, the combined audio signals from a time domain to a time-frequency domain that includes a number of frequency bins; determining, by the at least one audio processing circuit, a demixing matrix for each of the number of frequency bins; separating, by the at least one audio processing circuit, the first audio signal from the combined audio signals provided by the plurality of audio sources physically proximate the first audio source; and disambiguating, by the at least one audio processing circuit, the first audio signal to provide the first audio output signal.

According to example 17, there is provided a storage device that includes machine-readable instructions. The machine-readable instructions, when executed by at least one audio processing circuit, may cause the at least one audio processing circuit to: receive a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source; combine a plurality of audio signals, each of the audio signals representative of the audible ambient noise generated by a respective one of the plurality of audio sources physically proximate the first audio source; reduce the noise component in the first audio signal using the combined audio signals; and transmit a first audio output signal having a reduced noise component to a communicably coupled output interface portion.

Example 18 may include elements of example 17 where the machine-readable instructions that cause the at least one audio processing circuit to combine a plurality of audio signals, each of the audio signals representative of the audible ambient noise generated by a respective one of the plurality of audio sources physically proximate the first audio source, may further cause the at least one audio processing circuit to combine a plurality of audio signals, each of the audio signals representative of the audible ambient noise received by a respective microphone used by each of the plurality of audio sources physically proximate the first audio source.

Example 19 may include elements of example 17 where the machine-readable instructions that cause the at least one audio processing circuit to receive a first audio signal that includes an audible audio component generated by a first audio source and an ambient noise component, may further cause the at least one audio processing circuit to receive a first audio signal from a single microphone used by the first audio source via an input interface portion, the first audio signal including the audible audio component generated by the first audio source and the ambient noise component.

Example 20 may include elements of example 19 where the machine-readable instructions that cause the at least one audio processing circuit to receive a first audio signal at an input interface portion, the first audio signal including an audible audio component generated by a first audio source and an ambient noise component, may further cause the at least one audio processing circuit to receive a first audio signal at an input interface portion, the first audio signal including an audible audio component that includes at least a first voice call audible audio signal generated by a first audio source and an ambient noise component.

Example 21 may include elements of example 17 where the machine-readable instructions that cause the at least one audio processing circuit to receive a first audio signal via an input interface portion, the first audio signal including an audible audio component generated by a first audio source and an ambient noise component, the ambient noise component including an audio signal representative of an audible ambient noise generated by a plurality of audio sources physically proximate the first audio source, may further cause the at least one audio processing circuit to receive the first audio signal at the input interface portion, the first audio signal including an ambient noise component including an audio signal representative of an audible ambient noise including at least an audible voice call produced by each respective one of the plurality of audio sources physically proximate the first audio source.

Example 22 may include elements of example 17 where the machine-readable instructions that cause the at least one audio processing circuit to reduce the noise component in the first audio signal using the combined ambient audio signals, may further cause the at least one audio processing circuit to apply a Blind Sound Source Separation (BSSS) technique to reduce the noise component in the first audio signal using the combined audio signals from each of the plurality of audio sources physically proximate the first audio source.

Example 23 may include elements of example 22 where the machine-readable instructions that cause the at least one audio processing circuit to apply a Blind Sound Source Separation (BSSS) technique to reduce the noise component in the first audio signal using the combined audio signals from each of the plurality of audio sources physically proximate the first audio source, may further cause the at least one audio processing circuit to apply a convolutive BSSS technique to reduce the noise component in the first audio signal using the combined audio signals from the plurality of audio sources physically proximate the first audio source.

Example 24 may include elements of example 17 where the machine-readable instructions that cause the at least one audio processing circuit to reduce the noise component in the first audio signal using the combined audio signals from the plurality of audio sources physically proximate the first audio source, may further cause the at least one audio processing circuit to apply an Independent Component Analysis (ICA) to reduce the noise component in the first audio signal using statistically independent, combined audio signals from the plurality of audio sources physically proximate the first audio source.

Example 25 may include elements of example 22 where the machine-readable instructions that cause the at least one audio processing circuit to apply an Independent Component Analysis (ICA) to reduce the noise component in the first audio signal using statistically independent, combined audio signals from the plurality of audio sources physically proximate the first audio source comprises, may further cause the at least one audio processing circuit to, for each of the plurality of audio sources physically proximate the first audio source: convert the combined audio signals from a time domain to a time-frequency domain that includes a number of frequency bins; determine a demixing matrix for each of the number of frequency bins; separate the first audio signal from the combined audio signals from the remaining physically proximate audible audio sources; and disambiguate the first audio signal to provide the first audio output signal.

According to example 26, there is provided an audio signal processing system. The audio signal processing system may include a means for receiving a first audio signal that includes an audible audio component generated by a first audio source and an ambient noise component that includes an audio signal representative of an audible ambient noise generated by a plurality of audio sources physically proximate the first audio source. The system may further include a means for combining a plurality of audio signals, each of the audio signals representative of the audible ambient noise generated by a respective one of the plurality of audio sources physically proximate the first audio source. The system may additionally include a means for reducing the noise component in the first audio signal using the combined audio signals and a means for transmitting a first audio output signal having a reduced noise component to a communicably coupled output interface portion.

Example 27 may include elements of example 26 where the means for combining a plurality of audio signals, each of the audio signals representative of the audible ambient noise generated by a respective one of the plurality of audio sources physically proximate the first audio source may include a means for combining a plurality of audio signals, each of the audio signals representative of the audible ambient noise received by a respective microphone used by each of the plurality of audio sources physically proximate the first audio source. Example 28 may include elements of example 26 where the means for receiving a first audio signal that includes an audible audio component generated by a first audio source and an ambient noise component may include a means for receiving a first audio signal from a single microphone used by the first audio source, the first audio signal including the audible audio component generated by the first audio source and the ambient noise component.

Example 29 may include elements of example 28 where the means for receiving a first audio signal at an input interface portion, the first audio signal including an audible audio component generated by a first audio source and an ambient noise component may include a means for receiving a first audio signal that includes an audible audio component including at least a first voice call audible audio signal generated by a first audio source and an ambient noise component.

Example 30 may include elements of example 26 where the means for receiving a first audio signal that includes an audible audio component generated by a first audio source and an ambient noise component that includes an audio signal representative of an audible ambient noise generated by a plurality of audio sources physically proximate the first audio source may include a means for receiving the first audio signal that includes an ambient noise component including an audio signal representative of an audible ambient noise including at least a voice call sound produced by the respective audible audio source disposed physically proximate the first audio source.

Example 31 may include elements of example 26 where the means for reducing the noise component in the first audio signal using the combined ambient audio signals may include a means for applying a Blind Sound Source Separation (BSSS) technique to reduce the noise component in the first audio signal using the combined audio signals from the plurality of audio sources physically proximate the first audio source.

Example 32 may include elements of example 31 where the means for applying a Blind Sound Source Separation (BSSS) technique to reduce the noise component in the first audio signal using the combined audio signals from the remaining physically proximate audio sources may include a means for applying a convolutive BSSS technique to reduce the noise component in the first audio signal using the combined audio signals from the plurality of audio sources physically proximate the first audio source.

Example 33 may include elements of example 26 where the means for reducing the noise component in the first audio signal using the combined audio signals from the plurality of physically proximate audio sources may include a means for applying an Independent Component Analysis (ICA) to reduce the noise component in the first audio signal using statistically independent, combined audio signals from the plurality of audio sources physically proximate the first audio source.

Example 34 may include elements of example 33 where the means for applying an Independent Component Analysis (ICA) to reduce the noise component in the first audio signal using statistically independent, combined audio signals from the plurality of audio sources physically proximate the first audio source may include, for each of the plurality of audio sources physically proximate the first audio source: a means for converting the combined audio signals from a time domain to a time-frequency domain that includes a number of frequency bins; a means for determining a demixing matrix for each of the number of frequency bins; a means for separating the first audio signal from the combined audio signals provided by the plurality of audio sources physically proximate the first audio source; and a means for disambiguating the first audio signal to provide the first audio output signal.

According to example 35, there is provided a system for provision of reducing a noise present in an audio signal, the system being arranged to perform the method of any of examples 8 through 16.

According to example 36, there is provided a chipset arranged to perform the method of any of examples 8 through 16.

According to example 37, there is provided at least one machine readable medium comprising a plurality of instructions that, in response to be being executed on a computing device, cause the computing device to carry out the method according to any of examples 8 through 16.

According to example 38, there is provided a device configured for reducing a noise level present in an audio signal, the device being arranged to perform the method of any of examples 8 through 16.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. An audio signal processing controller for reducing noise in an audio signal, comprising:

an input interface portion;

an output interface portion; and at least one audio processing circuit communicably coupled to the input interface portion, the output interface portion, and at least one storage device; the at least one storage device including machine-readable instructions that, when executed by the at least one audio processing circuit, cause the at least one audio processing circuit to:

for a plurality of audio input signals provided by a respective plurality of physically proximate audio input devices:

buffer the plurality of audio input signals into contiguous frames;

merge the contiguous frames to generate a multidimensional frame in which each row corresponds to a respective frequency bins and each column corresponds to a respective one of the plurality of audio signals;

generate a multidimensional frame of spectral magnitude components by taking the absolute value of a Fast Fourier Transform (FFT) performed on each column included in the multidimensional frame;

perform a Blind Source Sound Separation (BSSS) technique on each row of the multidimensional frame of spectral magnitude components;

generate a plurality of matched frequency frames, each of the plurality of matched frequency frames representing a separated frequency component provided by the BSSS;

perform an inverse FFT on each of the frames included in the plurality of matched frequency frames to provide a plurality of intermediate audio signals;

generate an output frame by combining the intermediate audio signals to provide a mixed intermediate audio signal;

disambiguate the mixed intermediate audio signal to provide a plurality of disambiguated intermediate audio signals; and generate a plurality of audio output signals at the output interface portion by matching the each of the plurality of disambiguated intermediate audio signals to a respective one of the plurality of audio input signals.

2. The audio signal processing controller of claim 1, wherein the machine-readable instructions that cause the at least one audio processing circuit to perform a Blind Source Sound Separation (BSSS) technique on each row of the multidimensional frame of spectral magnitude components, further cause the at least one audio processing circuit to:

apply a convolutive BSSS technique on each row of the multidimensional frame of spectral magnitude components.

3. The audio signal processing controller of claim 1 wherein the machine-readable instructions that cause the at least one audio processing circuit to buffer the plurality of audio input signals into contiguous frames, causes the at least one audio processing circuit to:

buffer the plurality of audio input signals into a number of contiguous frames, wherein each audio input signal includes at least a voice call audio signal.

4. The audio signal processing controller of claim 1 wherein the machine-readable instructions that cause the at least one audio processing circuit to buffer the plurality of audio input signals into contiguous frames, causes the at least one audio processing circuit to:

buffer the plurality of audio input signals into contiguous frames, wherein each of the audio input signals includes an audible audio component that includes the voice call audio signal generated by a microphone associated with an audio source and an ambient noise component received from each of a plurality of microphones associated with each of a respective plurality of neighboring audio sources physically proximate the audio source associated with the microphone.

5. The audio signal processing controller of claim 4 wherein the instructions further cause the at least one audio processing circuit to:

apply an Independent Component Analysis (ICA) to reduce the ambient noise component in each respective one of the plurality of intermediate audio signals using statistically independent, combined audio signals from the neighboring audio sources physically proximate the audio source associated with the microphone.

6. The audio signal processing controller of claim 5 wherein the instructions that cause the at least one audio processing circuit to apply an Independent Component Analysis (ICA) to reduce the ambient noise component in each respective one of the plurality of audio signals using statistically independent, combined audio signals from the neighboring audio sources physically proximate the audio source associated with the microphone further cause the at least one audio processing circuit to:

for each of neighboring audio sources physically proximate the audio source associated with the microphone:

convert the merged audio input signals from a time domain to a time-frequency domain that includes a number of frequency bins;

determine a respective demixing matrix for each of the number of frequency bins;

separate the respective intermediate audio signal from the combined intermediate audio signals provided by the neighboring audio sources physically proximate the audio source associated with the microphone; and disambiguate the respective intermediate audio signal from the combined audio signals to provide an audio output signal corresponding to the audio input signal.

7. The audio signal processing controller of claim 1 wherein the instructions that cause the at least one audio processing circuit to buffer the plurality of audio input signals into a number of contiguous frames, further cause the at least one audio processing circuit to:

pass each of the plurality of audio input signals through a respective Finite Impulse Response (FIR) filter prior to buffering the plurality of audio input signals into a number of contiguous frames.

8. An audio signal processing method for reducing noise in an audio signal, comprising:

for a plurality of audio input signals provided by a respective plurality of physically proximate audio input devices:

buffering, by at least one audio processing circuit, the plurality of audio input signals into contiguous frames;

merging, by the at least one audio processing circuit, the contiguous frames to generate a multidimensional frame in which each row corresponds to a respective frequency bin and each column corresponds to a respective one of the plurality of audio input signals;

generating, by the at least one audio processing circuit, a multidimensional frame of spectral magnitude components by taking the absolute value of a Fast Fourier Transform (FFT) performed on each column included in the multidimensional frame;

performing, by the at least one audio processing circuit, a Blind Source Sound Separation (BSSS) technique on each row of the multidimensional frame of spectral magnitude components;

generating, by the at least one audio processing circuit, a plurality of matched frequency frames, each of the plurality of matched frequency frames representing a separated frequency component provided by the BSSS;

performing, by the at least one audio processing circuit, an inverse FFT on each of the frames included in the plurality of matched frequency frames to provide a plurality of intermediate audio signals;

generating, by the at least one audio processing circuit, an output frame by combining the intermediate audio signals to provide a mixed intermediate audio signal;

disambiguating, by the at least one audio processing circuit, the mixed intermediate audio signal to provide a plurality of disambiguated intermediate audio signals; and generating, by the at least one audio processing circuit, a plurality of audio output signals at the output interface portion by matching the each of the plurality of disambiguated intermediate audio signals to a respective one of the plurality of audio input signals.

9. The audio signal processing method of claim 8 wherein buffering the plurality of audio input signals into contiguous frames further comprises:

buffering, by the at least one audio processing circuit, the plurality of audio input signals into contiguous frames, wherein each of the plurality of audio input signals includes an ambient noise component representative of the audible ambient noise generated by respective ones of a plurality of physically proximate audio sources.

10. The audio signal processing method of claim 9, wherein reducing the noise component in the first audio signal using the combined audio signals from the plurality of physically proximate audio sources comprises further comprising:

applying, by the at least one audio processing circuit, an Independent Component Analysis (ICA) to reduce the noise component in the first each respective one of the plurality of intermediate audio signals signal using statistically independent, combined intermediate audio signals from the plurality of the neighboring audio sources physically proximate the first audio source associated with the microphone.

11. The audio signal processing method of claim 10 wherein applying an Independent Component Analysis (ICA) to reduce a noise component in each respective one of the plurality of intermediate audio signals using statistically independent, combined audio signals from a remaining portion of a plurality of audio sources physically proximate the audio source providing the respective intermediate audio signal comprises:

for each of the neighboring audio sources physically proximate the audio source associated with the microphone:

converting, by the at least one audio processing circuit, the merged audio input signals from a time domain to a time-frequency domain that includes a number of frequency bins;

determining, by the at least one audio processing circuit, a demixing matrix for each of the number of frequency bins;

separating, by the at least one audio processing circuit, the intermediate audio signal from the combined audio signals provided by the neighboring audio sources physically proximate the first audio source associated with the microphone; and disambiguating, by the at least one audio processing circuit, the intermediate audio signal from the combined intermediate audio signals to provide an audio output signal corresponding to the audio input signal.

12. The audio signal processing method of claim 8 wherein buffering the plurality of audio input signals into contiguous frames further comprises:

buffering, by the at least one audio processing circuit, the plurality of audio input signals into contiguous frames, each of the audio input signals including an audible audio component generated by a microphone associated with an audio source and the ambient noise component representative of the audible ambient noise generated by respective ones of the plurality of physically proximate audio sources.

13. The audio signal processing method of claim 12 wherein buffering a plurality of audio input signals into a number of contiguous frames further comprises:

buffering, by the at least one audio processing circuit, the plurality of audio input signals into contiguous frames, each of the audio input signals including an audible audio component that includes at least a voice call audible audio signal generated by a microphone associated with an audio source and the ambient noise component representative of the audible ambient noise generated by respective ones of the plurality of physically proximate audio sources.

14. The audio signal processing method of claim 13 wherein buffering the plurality of audio input signals into contiguous frames further comprises:

buffering, by the at least one audio processing circuit, the plurality of audio input signals into contiguous frames, each of the audio input signals including an audible audio component that includes at least a voice call audible audio signal generated by a microphone associated with an audio source and the ambient noise component that includes a plurality of voice calls, each generated by respective ones of the plurality of physically proximate audio sources.

15. A storage device that includes machine-readable instructions that when executed by at least one audio processing circuit, causes the at least one audio processing circuit to:

for a plurality of audio input signals provided by a respective plurality of physically proximate audio input devices:

buffer the plurality of audio input signals into contiguous frames;

merge the contiguous frames to generate a multidimensional frame in which each row corresponds to a respective frequency bin and each column corresponds to a respective one of the plurality of audio input signals;

generate a multidimensional frame of spectral magnitude components by taking the absolute value of a Fast Fourier Transform (FFT) performed on each column included in the multidimensional frame;

perform a Blind Source Sound Separation (BSSS) technique on each row of the multidimensional frame of spectral magnitude components;

generate a plurality of matched frequency frames, each of the plurality of matched frequency frames representing a separated frequency component provided by the BSSS;

perform an inverse FFT on each of the frames included in the plurality of matched frequency frames to provide a plurality of intermediate audio signals;

generate an output frame by combining the intermediate audio signals to provide a mixed intermediate audio signal;

disambiguate the mixed intermediate audio signal to provide a plurality of disambiguated intermediate audio signals; and generate a plurality of audio output signals at the output interface portion by matching the each of the plurality of disambiguated intermediate audio signals to a respective one of the plurality of audio input signals.

16. The storage device of claim 15 wherein the machine-readable instructions that cause the at least one audio processing circuit to buffer the plurality of audio input signals into contiguous frames, further cause the at least one audio processing circuit to:

buffer the plurality of audio input signals into contiguous frames, each of the audio input signals including: a first audio signal received from a microphone, the first audio signal including the audible audio component generated by a first audio source associated with the microphone and an ambient noise component received from each of the plurality of microphones associated with each of the respective plurality of neighboring audio sources physically proximate the first audio source.

17. The storage device of claim 16 wherein the machine-readable instructions that cause the at least one audio processing circuit to buffer the plurality of audio input signals into contiguous frames, each of the audio input signals including: a first audio signal received from a microphone, the first audio signal including the audible audio component generated by a first audio source associated with the microphone and an ambient noise component received from each of the plurality of microphones associated with each of the respective plurality of neighboring audio sources physically proximate the first audio source, further cause the at least one audio processing circuit to:

buffer the plurality of audio input signals into contiguous frames, each of the audio input signals including: the first audio signal received from the microphone, the first audio signal including the audible audio component that includes at least a first voice call audible audio signal generated by the first audio source associated with the microphone and an ambient noise component received from each of the plurality of microphones associated with each of the respective plurality of neighboring audio sources physically proximate the first audio source.

18. The storage device of claim 17 wherein the machine-readable instructions that cause the at least one audio processing circuit to buffer the plurality of audio input signals into contiguous frames, each of the audio input signals including: the first audio signal received from the microphone, the first audio signal including the audible audio component that includes at least a first voice call audible audio signal generated by the first audio source associated with the microphone and an ambient noise component received from each of the plurality of microphones associated with each of the respective plurality of neighboring audio sources physically proximate the first audio source, further cause the at least one audio processing circuit to:

buffer the plurality of audio input signals into contiguous frames, each of the audio input signals including: the first audio signal received from the microphone, the first audio signal including the audible audio component that includes at least a first voice call audible audio signal generated by the first audio source associated with the microphone and an ambient noise component received from each of the plurality of microphones associated with each of the respective plurality of neighboring audio sources physically proximate the first audio source, the ambient noise component including one or more audible voice calls produced by each respective one of the plurality of neighboring audio sources physically proximate the first audio source.

* * * * *